US007568920B2

(12) United States Patent
Hou et al.

(10) Patent No.: US 7,568,920 B2
(45) Date of Patent: Aug. 4, 2009

(54) COMPUTER INPUT DEVICE HAVING AN ELECTRICAL CONNECTOR

(75) Inventors: Ding-Teng Hou, Sanchung (TW); Huei-Jen Chang, Sanchung (TW)

(73) Assignee: KYE Systems Corp., Taipei Hsien (TW)

( * ) Notice: Subject to any disclaimer, the term of this patent is extended or adjusted under 35 U.S.C. 154(b) by 0 days.

(21) Appl. No.: 12/199,197

(22) Filed: Aug. 27, 2008

(65) Prior Publication Data

US 2009/0111333 A1 Apr. 30, 2009

(30) Foreign Application Priority Data

Oct. 31, 2007 (TW) ..... 96140906 A

(51) Int. Cl.
*H01R 12/00* (2006.01)

(52) U.S. Cl. ..... 439/76.1; 439/660; 439/629; 439/874

(58) Field of Classification Search ..... 439/76.1, 439/629, 630, 660, 874, 875, 876
See application file for complete search history.

(56) References Cited

U.S. PATENT DOCUMENTS 3,315,217 A * 4/1967 Bird ..... 439/630
4,478,476 A * 10/1984 Jones ..... 439/525
4,891,019 A * 1/1990 Olsson ..... 439/404
5,118,312 A * 6/1992 Lu ..... 439/676
5,425,646 A * 6/1995 Green ..... 439/79
5,746,626 A * 5/1998 Kwiat et al. ..... 439/630
5,920,252 A * 7/1999 Nakagawa ..... 338/160
6,196,879 B1 * 3/2001 Hess et al. ..... 439/676
6,238,237 B1 * 5/2001 Nagahata et al. ..... 439/493
6,655,997 B2 * 12/2003 Lam et al. ..... 439/746
7,273,390 B2 * 9/2007 Iida et al. ..... 439/494
2006/0276075 A1 * 12/2006 Iida et al. ..... 439/492

* cited by examiner

*Primary Examiner*—James Harvey
(74) *Attorney, Agent, or Firm*—Rabin & Berdo, P.C.

(57) ABSTRACT

An electrical connector of a computer peripheral device has an insulating base having a plurality of slots spaced along the side of the insulating base and each of the slots having a conductive terminal. Each of the conductive terminals has a first end and a second end. The first end protrudes up from the insulating base for electrically contact to a printed circuit board which is located above the insulating base within the computer peripheral device. The second end extends away from the insulating base for electrically coupling to a cable of the computer peripheral device. Therefore the electrical connector facilitates the connection between the printed circuit board and the cable of the computer peripheral device.

8 Claims, 5 Drawing Sheets

COMPUTER INPUT DEVICE HAVING AN ELECTRICAL CONNECTOR

BACKGROUND OF THE INVENTION

1. Field of the Invention

The present invention relates to an electrical connector, especially to an electrical connector that facilitates connecting a printed circuit board of a computer peripheral device with a cable.

2. Description of the Related Art

Computer peripheral devices are indispensable for operating a computer. A computer peripheral device, like a mouse, may comprise a base, a printed circuit board and a cable. The printed circuit board is mounted on the base and has a plurality of signal contacts formed on a surface of the printed circuit board. The cable has a plurality of terminals formed on an end of the cable and being respectively soldered on the signal contacts of the printed circuit board to be electrically connected to the printed circuit board.

However, the solder may deform easily due to high temperature, man-made errors or low precision, and then weaken connection between the printed circuit board and the cable and finally lead to product failure and consumption of time and cost.

To overcome the shortcomings, the present invention provides an electrical connector to mitigate or obviate the aforementioned problems.

SUMMARY OF THE INVENTION

The main objective of the invention is to provide an electrical connector of a computer peripheral device that facilitates connecting a printed circuit board of the computer peripheral device with a cable.

The electrical connector in accordance with the present invention comprises an insulating base having a plurality of slots spaced along the side of the insulating base and each of the slots having a conductive terminal. Each of the conductive terminals has a first end and a second end. The first end protrudes up from the insulating base for electrically contact to a printed circuit board which is located above the insulating base within the computer peripheral device. The second end extends away from the insulating base for electrically coupling to a cable of the computer peripheral device. Therefore the electrical connector facilitates the connection between the printed circuit board and the cable of the computer peripheral device.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
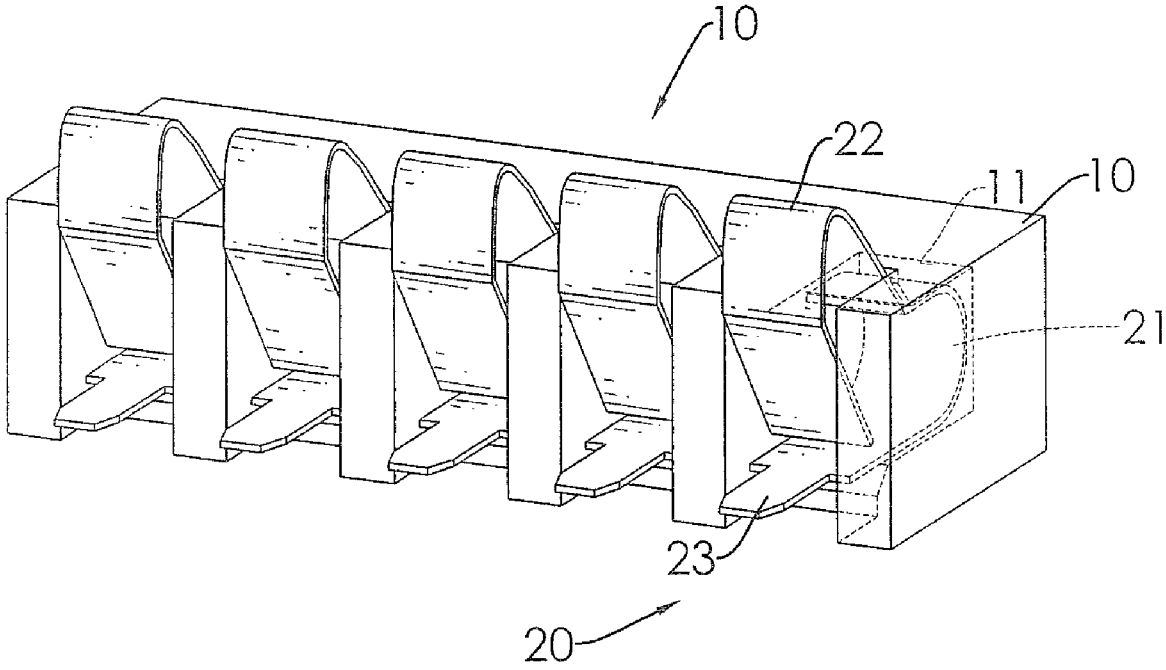
FIG. 1 is a perspective view of an electrical connector in accordance with the present invention.

With reference to FIG. 1, an electrical connector (1) in accordance with the present invention comprises an insulating base (10).

The insulating base (10) has a side and a plurality of slots (11) and may be a rectangular solid. The slots (11) are spaced along the side of the insulating base (10). Each of the slot (11) has a conductive terminal (20).

Each of the conductive terminals (20) are metallic and bent and has a first end protruding up from the insulating base (10) and a second end extending away from the insulating base (10) and may have a mounting portion (21), a contact portion (22) and a pin portion (23). The mounting portion (21) is U-shaped and mounted in a corresponding slot (11) of the insulating base (10). The contact portion (22) is formed on and extends up from a top end of the mounting portion (21) and protrudes out from the insulating base (10) and may be implemented as the first end of the conductive terminal (20). The pin portion (23) is formed on and horizontally extends forward from a bottom end of the mounting portion (21) under the contact portion (22) and has an unbent free end and may be implemented as the second end of the conductive terminal (20).

Figure 2:
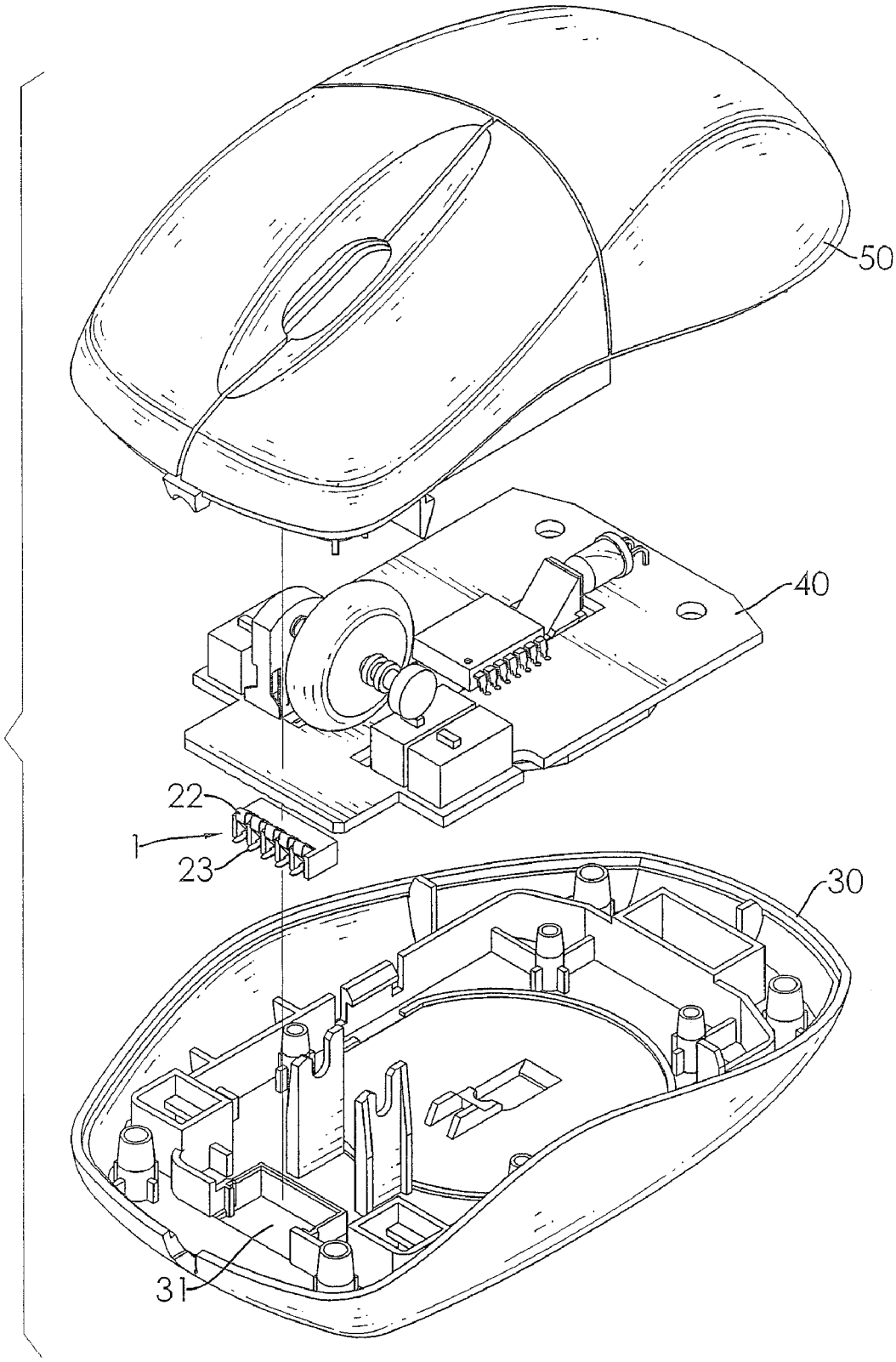
FIG. 2 is a perspective operational view of assembling a printed circuit board, a base, a cover and the electrical connector as in FIG. 1.

With further reference to FIG. 2, the electrical connector (1) is implemented as a component of a computer peripheral device. The computer peripheral device may be a mouse and further has a base (30), an electrical connector (1), a printed circuit board (40) and a cover (50) in addition to the electrical connector (1).

The base (30) has a mounting slot (31). The mounting slot (31) corresponds to and receives the insulating base (10) of the electrical connector (1) and has a front opening exposing the side of the insulating base (10) and the pin portions (23) of the conductive terminals (20) of the electrical connector (1).

Figure 3:
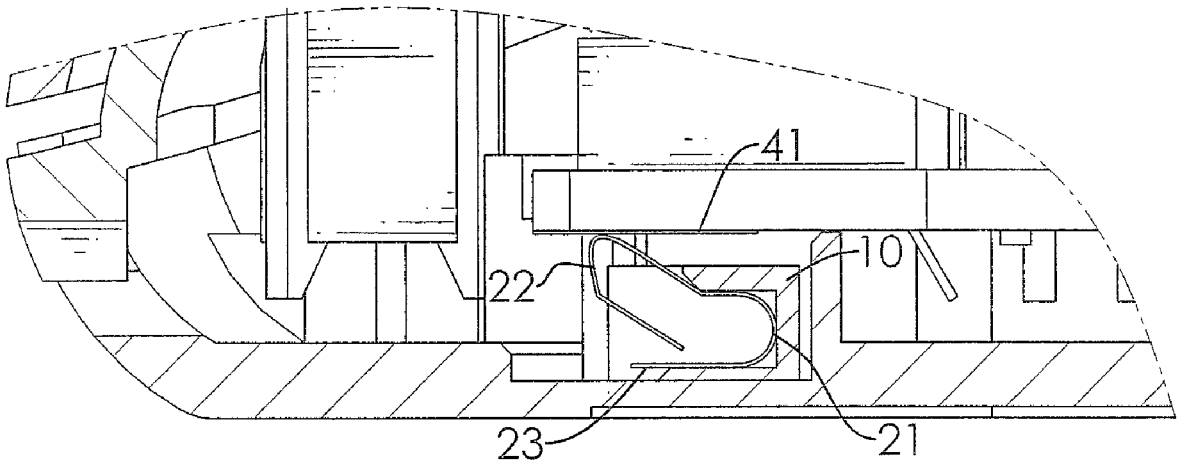
FIG. 3 is a side view in partial section of a combination of a printed circuit board, a base, a cover and the electrical connector as in FIG. 1.

With further reference to FIG. 3, the printed circuit board (40) is mounted on the base (31), located above the insulating base (10) within the computer peripheral device, electrically contact to the first ends of the conductive terminals (20) and may have a plurality of signal contacts (41). The signal contacts (41) are formed on a bottom surface of the printed circuit board (40) and respectively abut the contact portions (22) of the conductive terminals (20). Since the contact portions (22) protrude out from the insulating base (10) and the conductive terminals (20) are metallic and has a little elasticity, therefore the contact portions (22) can tightly contact the signal contacts (41) when the printed circuit board (40) is mounted on the base (30).

The cover (50) is mounted on the base (30) and covers the printed circuit board (40) and the electrical connector (1).

Figure 4:
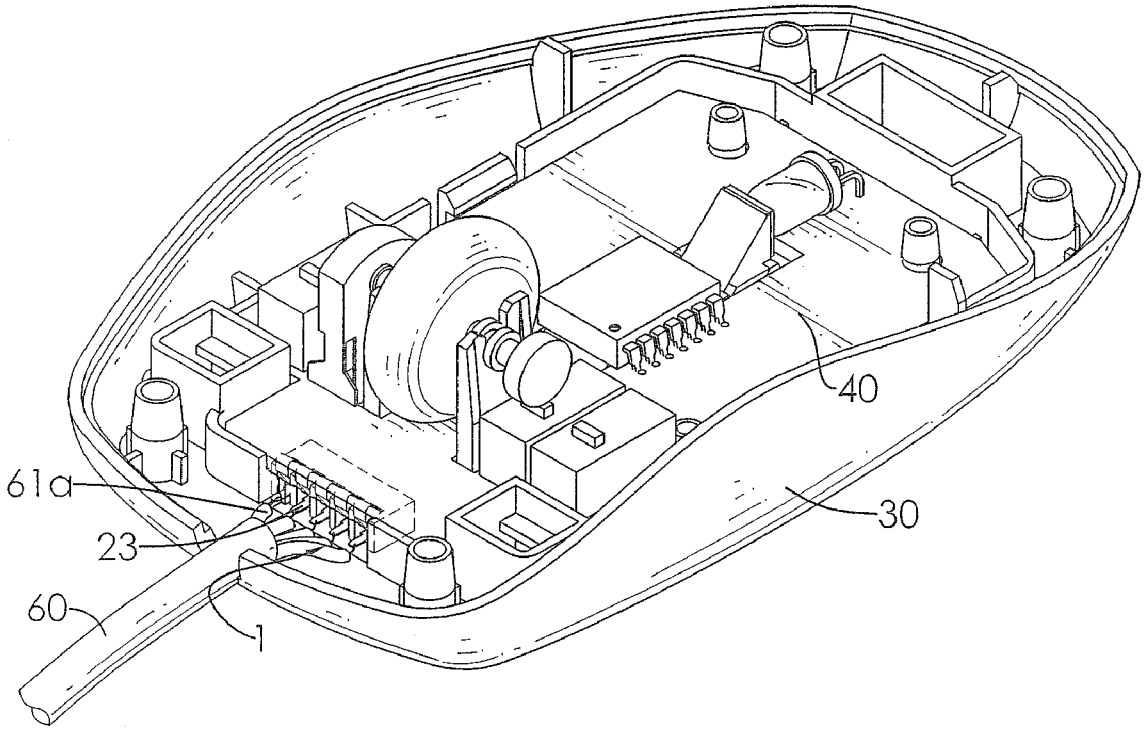
FIG. 4 is a perspective view of a combination of a printed circuit board, a base and the electrical connector as in FIG. 1.
Figure 5:
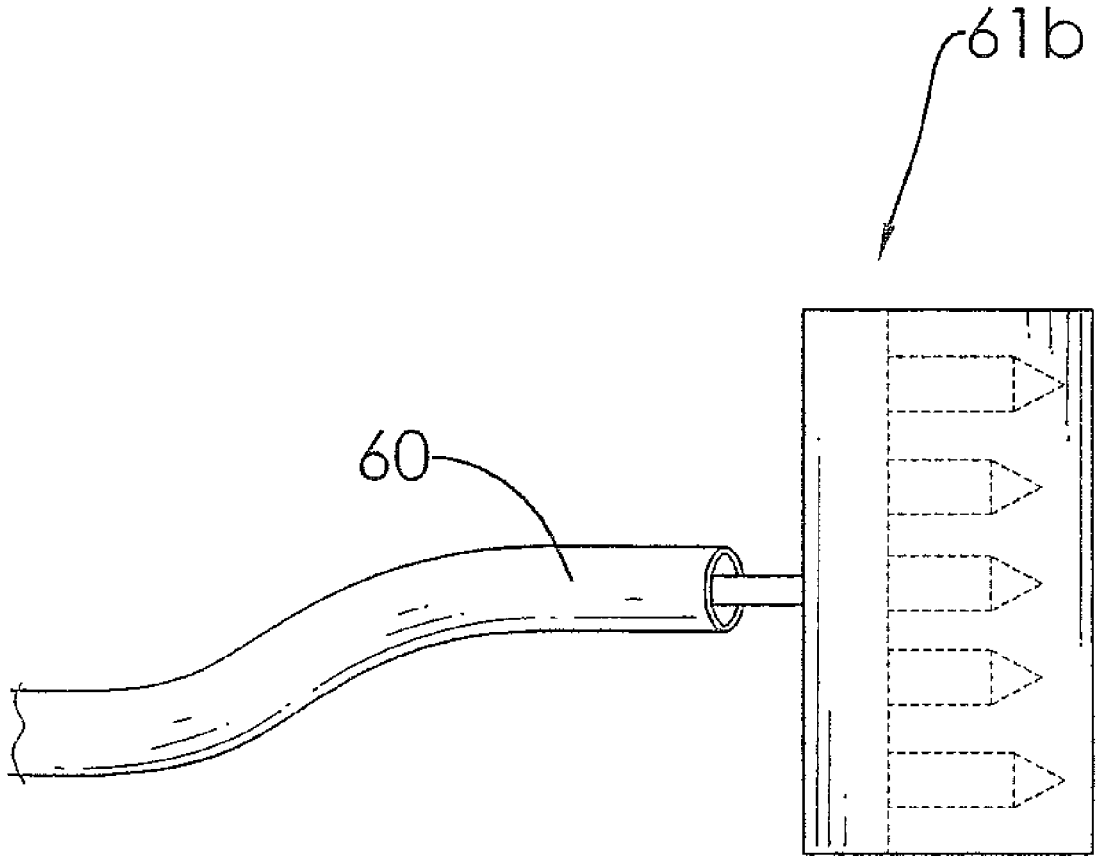
FIG. 5 is a top view of a cable for connecting the electrical connection as in FIG. 1.

With further reference to FIG. 4, since the printed circuit board (40) securely connects with the electrical connector (1), the second ends of the conductive terminals (20) may electrically couple to a cable (60) of the computer peripheral device. The cable (60) then electrically connects to the printed circuit board (40) via the conductive terminals (20) to transmit signals. The cable (60) may have a plurality of leads (61*a*) extending from an end of the cable (60) and the pin portions (23) are for being respectively soldered to the leads (61*a*) of the cable (60). With further reference to FIG. 5, the cable (60) may have a plug (61*b*) having a plurality of pins respectively corresponding to the pin portions (23).

In conclusion, the electrical connector (1) facilitates the connection between the printed circuit board (40) and the cable (60) and has advantages of low cost and assembling time-saving and may be able to be applied in automation manufacturing to increase productivity of computer peripheral devices.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A computer input device, comprising:

a base having a mounting slot;

a cover mounted on the base;

a printed circuit board positioned between the base and the cover, the printed circuit board having a plurality of signal contacts;

a cable having an end electrically connectable to a computer; and an electrical connector positioned between the base and the printed circuit board, the electrical connector being connected to the end of the cable and having:

an insulating base, the insulating base being mounted in the mounting slot of the base and having a plurality of slots, and a plurality of conductive terminals respectively mounted in the slots of the insulating base, each conductive terminal having:

a mounting portion mounted in a corresponding slot of the insulating base, a contact portion formed on and extending up from a top end of the mounting portion, the contact portion protruding out from the insulating base and electrically contacting with a corresponding signal contact of the printed circuit board, and a pin portion formed on and horizontally extending forward from a bottom end of the mounting portion under the contact portion, the pin portion having an unbent free end connected to the end of the cable.

2. The computer input device as claimed in claim 1, wherein the mounting slot of the base has a front opening exposing the pin portion, and the signal contacts of the printed circuit board are formed on a bottom surface of the printed circuit board.

3. The computer input device as claimed in claim 1, wherein the cable includes a plug having a plurality of pins respectively connecting to each pin portion of the conductive terminals.

4. The computer input device as claimed in claim 1, wherein the cable includes a plurality of leads extending from the end of the cable and respectively soldered to each pin portion of the conductive terminals.

5. The computer input device as claimed in claim 2, wherein the cable has a plug having a plurality of pins respectively corresponding to each pin portion of the conductive terminals.

6. The computer input device as claimed in claim 2, wherein the cable includes a plurality of leads extending from the end of the cable and respectively soldered to the pin portions of the conductive terminals.

7. A wired computer input device, comprising:

a cable;

a cover;

a base;

a printed circuit board positioned between the cover and the base, the printed circuit board having a plurality of signal contacts; and an electrical connector having an insulating base for receiving a plurality of conductive terminals therein, the insulating base having a plurality of slots for receiving corresponding ones of the plurality of conductive terminals, the conductive terminals each having a contact portion and a pin portion such that each of the signal contacts of the printed circuit board electronically contacts with a corresponding contact portion, wherein the electrical connector is positioned between the base and the printed circuit board, and each of the pin portions couples to one end of the cable.

8. The wired computer input device as claimed in claim 7, wherein the base includes a mounting slot for positioning the insulating base.

* * * * *